US008312965B2

(12) United States Patent
Petzl et al.

(10) Patent No.: US 8,312,965 B2
(45) Date of Patent: Nov. 20, 2012

(54) BELAY AND ABSEILING APPARATUS FOR SINGLE OR DOUBLE ROPE

(75) Inventors: Paul Petzl, Barraux (FR); Laurent Perrod, Pinsot (FR)

(73) Assignee: Zedel, Crolles (FR)

( * ) Notice: Subject to any disclaimer, the term of this patent is extended or adjusted under 35 U.S.C. 154(b) by 1045 days.

(21) Appl. No.: 12/087,666

(22) PCT Filed: Jan. 10, 2007

(86) PCT No.: PCT/FR2007/000039

§ 371 (c)(1),
(2), (4) Date: Aug. 18, 2008

(87) PCT Pub. No.: WO2007/080316

PCT Pub. Date: Jul. 19, 2007

(65) Prior Publication Data

US 2009/0026011 A1 Jan. 29, 2009

(30) Foreign Application Priority Data

Jan. 12, 2006 (FR) ..... 06 00284

(51) Int. Cl.
*A63B 29/02* (2006.01)

(52) U.S. Cl. ..... 182/5; 182/193; 188/65.2

(58) Field of Classification Search ..... 182/5, 6, 182/72, 193; 188/65.2
See application file for complete search history.

(56) References Cited

U.S. PATENT DOCUMENTS

| | | | | |
|---|---|---|---|---|
| 629,548 | A * | 7/1899 | cranford | 182/5 |
| 3,814,210 | A * | 6/1974 | Hoffman | 182/6 |
| 5,850,890 | A * | 12/1998 | Couttet | 182/5 |
| D466,794 | S * | 12/2002 | Malkiel | D8/356 |
| 6,561,313 | B2 * | 5/2003 | Hewlett et al. | 182/5 |
| 6,681,891 | B2 * | 1/2004 | Richard et al. | 182/5 |
| 7,500,290 | B2 * | 3/2009 | Klingler | 24/115 R |
| D593,844 | S * | 6/2009 | Petzl | D8/356 |
| 2007/0187176 | A1 * | 8/2007 | Christianson | 182/5 |
| 2011/0011671 | A1 * | 1/2011 | Chu | 182/5 |
| 2011/0114415 | A1 * | 5/2011 | Chu | 182/5 |

(Continued)

FOREIGN PATENT DOCUMENTS

DE 89 04 030 U1 5/1989

(Continued)

OTHER PUBLICATIONS

American Psychological Association (APA): bow. (n.d.). The American Heritage® Dictionary of Idioms by Christine Ammer. Retrieved Sep. 28, 2011, from Dictionary.com website: http://dictionary.reference.com/browse/bow.*

(Continued)

*Primary Examiner* — Katherine W Mitchell
*Assistant Examiner* — Candace L Bradford
(74) *Attorney, Agent, or Firm* — Oliff & Berridge, PLC

(57) ABSTRACT

A belaying device for a rope comprises a metal body having at least one slit for passage of a loop of a rope, and a retaining element in the form of a bow integral to the body without being articulated on the latter, and designed to control the relative separation movement of the body with respect to a carabiner passing through the loop. The device further comprises flexible means arranged to move the body towards the carabiner when blocking of the rope takes place, and to move the body away automatically when the rope is released.

13 Claims, 7 Drawing Sheets

U.S. PATENT DOCUMENTS

2011/0284323 A1* 11/2011 Ayre ..... 182/5
2012/0111665 A1* 5/2012 Paglioli ..... 182/5

FOREIGN PATENT DOCUMENTS

FR 2 631 325 A1 11/1989

OTHER PUBLICATIONS

American Psychological Association (APA): strap. (n.d.). Dictionary.com Unabridged. Retrieved Sep. 28, 2011, from Dictionary.com website: http://dictionary.reference.com/browse/strap.*

* cited by examiner

BELAY AND ABSEILING APPARATUS FOR SINGLE OR DOUBLE ROPE

BACKGROUND OF THE INVENTION

The invention relates to a belaying device for a rope comprising:

- a metal body having at least one slit for a loop of a rope to pass,
- a retaining element securely attached to the body without being articulated on the latter, and designed to control the relative separation movement of the body with respect to a carabiner passing through said loop.

This type of safety device is designed to accompany and secure climbers when ascending, in particular when the leader progresses belayed by the second climber in the event of a fall. It can also serve the purpose of belaying the second when the leader has reached a secured point. In addition to the functions of belaying the leader or second, the device also enables rappelling ensuring the safety of the descender enabling him/her to curb his/her speed.

STATE OF THE ART

A first type of belay/rescue plate exists in the form of a tube with one or two slits, the tube being fixed to a securing bow. When sliding of the rope takes place in normal operation, the presence of the bow prevents the body from moving away from a carabiner passing through said loop, but the carabiner can move inside the opening defined by the bow. In the event of the leader falling, the carabiner is pressed against the body when blocking of the rope takes place. A manual releasing action is then necessary to free the rope, which is not always easy for the belayer when the rope is wet and he is wearing gloves.

A second type of belay/rescue plate uses a plate with two slits on which a helical spring is crimped. The carabiner passes through one or two loops depending on whether the rope is single or double, and compresses the spring when the rope is secured. Release of the rope is achieved by relaxation of the spring after the tractive force on the rope has disappeared, but the lack of securing of the body means the latter tends to move away from the carabiner.

A belaying device also exists called Toucan having a mobile flange-plate articulated on the fixed body of the device so as to be able to swivel between a close position and a deployed position. The relative distance of the body with respect to the attachment carabiner passing through said loop is not optimized when the flange-plate is in the deployed position.

OBJECT OF THE INVENTION

The object of the invention consists in providing a versatile belaying device combining the functions of releasing the rope and of securing the body of the device on one and the same device so as to achieve optimum belaying safety.

The belaying device according to the invention is characterized in that it further comprises elastic means arranged to bring the body of the carabiner closer when blocking of the rope takes place, and to move the latter away automatically when the rope is released.

The elastic means can be integral to the retaining element or be separated from the latter and be attached directly to the body.

According to a preferred embodiment, the retaining element is achieved by means of a flexible material constituting said elastic means and is provided with attachment means and/or a securing part of the carabiner. The metal body with one or two slits can be formed by a tubular plate or a central flange-plate on which a U-shaped clamp is fixed.

The retaining element can be formed by a flexible bow fixed to the belaying device to secure the carabiner near the body and foster release of the rope in the event of the mechanical strain decreasing.

BRIEF DESCRIPTION OF THE DRAWINGS

Other advantages and features will become more clearly apparent from the following description of particular embodiments of the invention given for non-restrictive example purposes only and represented in the accompanying drawings, in which.

DESCRIPTION OF PARTICULAR EMBODIMENTS

Figure 1:
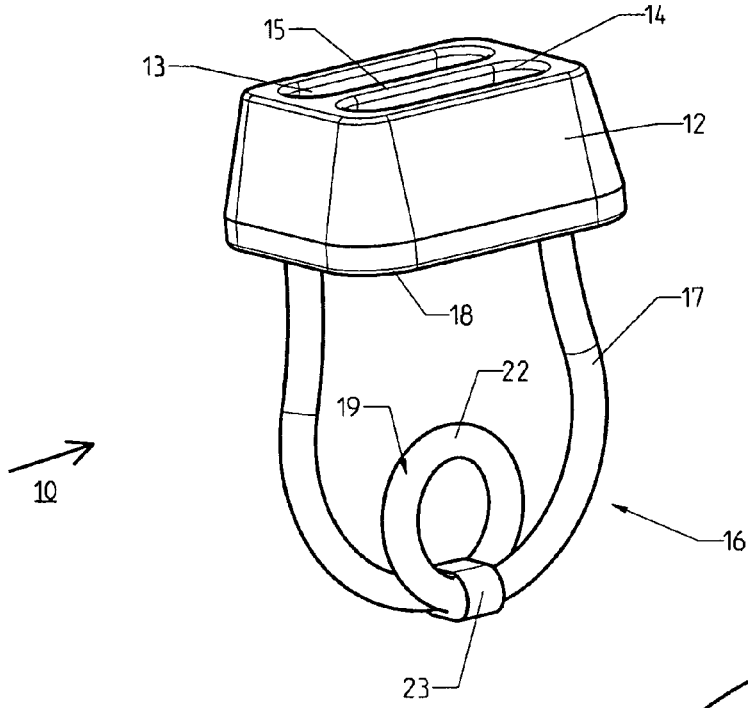
FIG. 1 represents a schematic perspective view of a belaying device according to the invention, the carabiner not being fitted.
Figure 2:
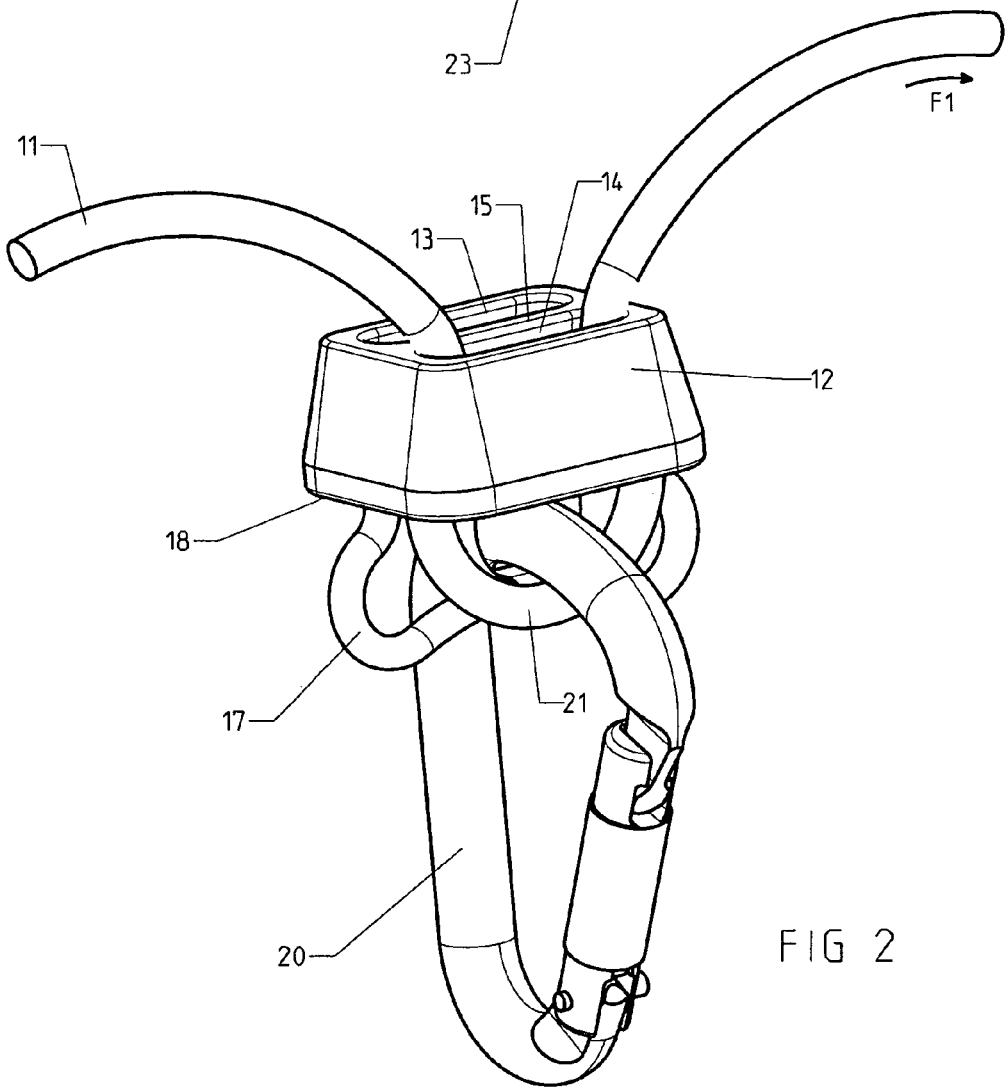
FIG. 2 is an identical view to FIG. 1 when blocking of the rope and flexible deformation of the bow take place.

With reference to FIGS. 1 and 2, a belaying device 10 for a rope 11 comprises a metal body 12 arranged as a tubular plate which is provided with two oblong slits 13, 14 for the rope to pass. The two slits 13, 14 are parallel and arranged side by side being separated from one another by an intermediate wall 15.

A retaining element 16 comprises a bow 17, the two ends of which are secured to the body 12 by crimping or any other fixing method. Bow 17 is situated in a plane extending perpendicularly to the inside face 18 of body 12, and is achieved by means of a flexible material allowing flexible deformation when blocking of rope 11 takes place. Bow 17 is preferably achieved by means of a sheath made from very strong plastic in which an internal reinforcing armature can be integrated. Bow 17 can also be formed by a very flexible cable.

Attachment means 19 are located in the mid-part of bow 17 to enable a carabiner 20 to be fitted. Attachment means 19 are formed for example by an intermediate closed turn 22 arranged inside bow 17 and having an internal diameter corresponding to the cross-section of carabiner 20. The latter is held without clearance in attachment means 19, and extends orthogonally with respect to bow 17. Turn 22 is secured by a strap 23 crimped onto bow 17.

Operation of belaying device 10 according to FIGS. 1 and 2 is as follows:

A single rope 11 is represented in FIG. 2 after a loop 21 of rope 11 has been passed through slit 14. Carabiner 20 passes through loop 21 of rope 11 and is simultaneously hooked onto a ring of the belayer's harness.

A double rope (not shown) can be used after passage of a second loop in the other slit 13. In this case, carabiner 20 passes through the two juxtaposed loops of the double rope.

In both cases, bow 17 constitutes the deformable connecting part between body 12 and the harness ring.

During normal progression of the leader, the belayer, who is for example the second, controls free sliding of rope 11, for bow 17 remains in the separated position of FIG. 1. Carabiner 20 also remains in the separated position enabling free sliding of rope 11. Bow 17 keeps carabiner 20 in this position, but without moving the latter away from belaying device 10. The relative separation movement of body 12 with respect to carabiner 20 passing through loop 21 is thereby controlled.

Should the leader fall, the tension exerted on the upline strand of rope 11 (see arrow F1) makes carabiner 20 move towards the inside face 18 of body 12 following flexible deformation of bow 17 (see FIG. 2). The large friction effect exerted by loop 21 of rope 11 on carabiner 20 blocks the rope and results in the climber's fall being immediately stopped.

After the tension has disappeared, releasing of rope 11 then takes place automatically due to the flexible return of bow 17 to the separated position of FIG. 1.

The presence of flexible bow 17 of belaying device 10 both enables carabiner 20 to be kept near to body 12, and enhances release of rope 11 in the absence of mechanical strain. The material of bow 17 is chosen to enable flexion in both directions between the close position (FIG. 2) and separated position (FIG. 1).

FIGS. 3 to 8 show different alternative embodiments. The same reference numbers will be used to designate identical or similar parts.

Figure 3:
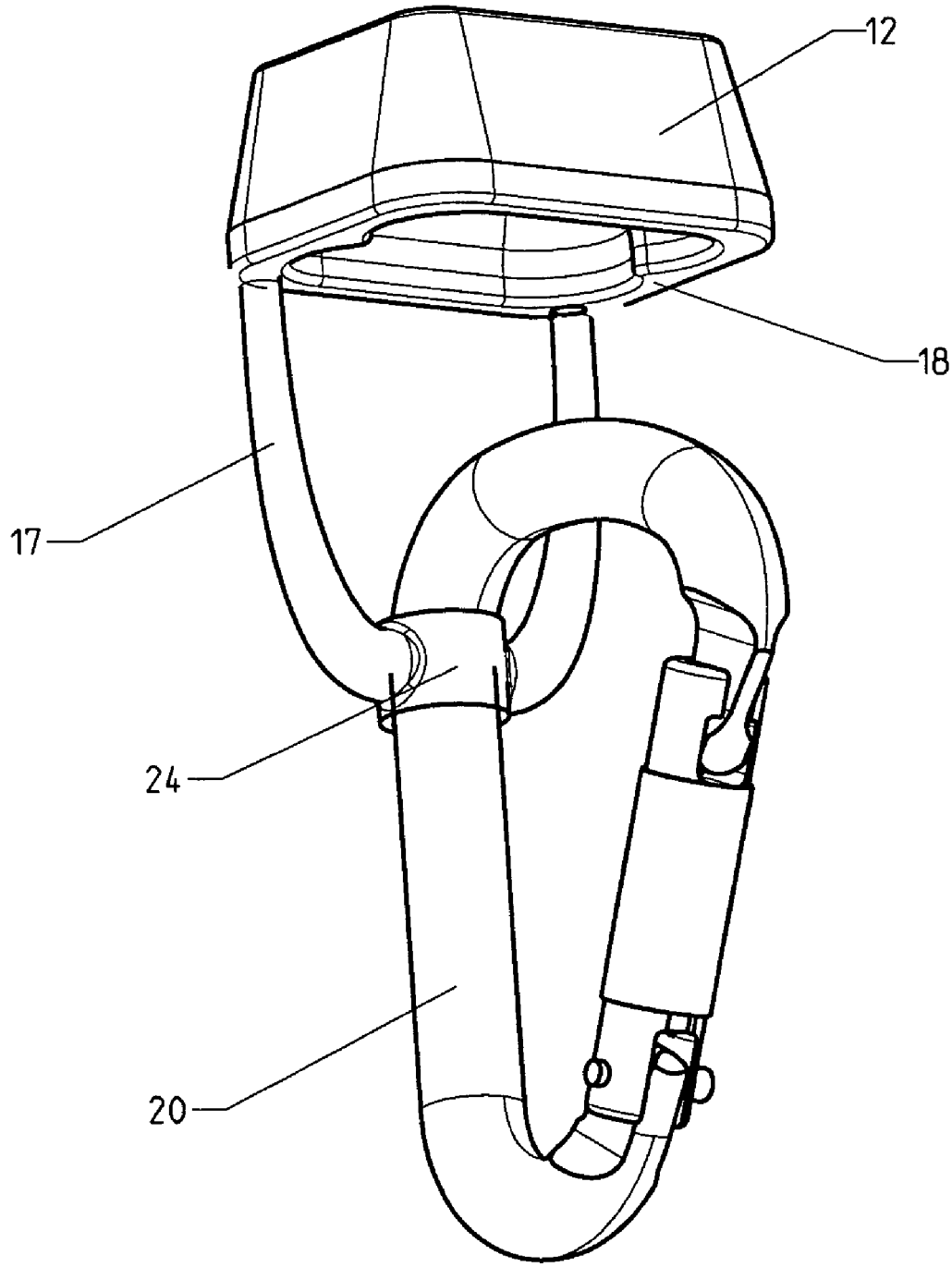
FIGS. 3 to 8 show identical views to FIG. 1 of different embodiments.

In FIG. 3, carabiner 20 is securely attached to bow 17 by means of a securing part 24, in particular made of elastomer. Carabiner 20 is then fitted captively.

Figure 4:
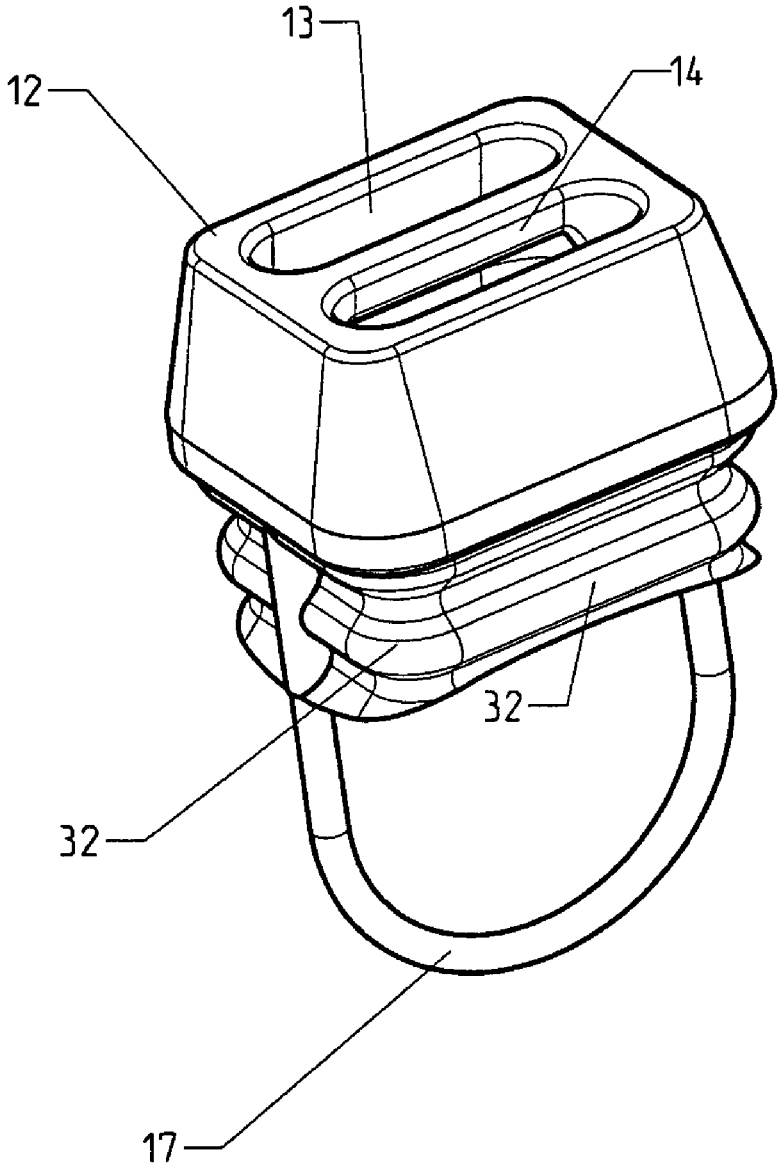

In FIG. 4, bow 17 is made from rigid or semi-rigid material, but without being elastic. Bow 17 is independent from the flexible means which are formed by a skirt 32 of deformable flexible material, for example made from elastomer or rubber, said skirt being attached to body 12 under slits 13, 14.

Figure 5:
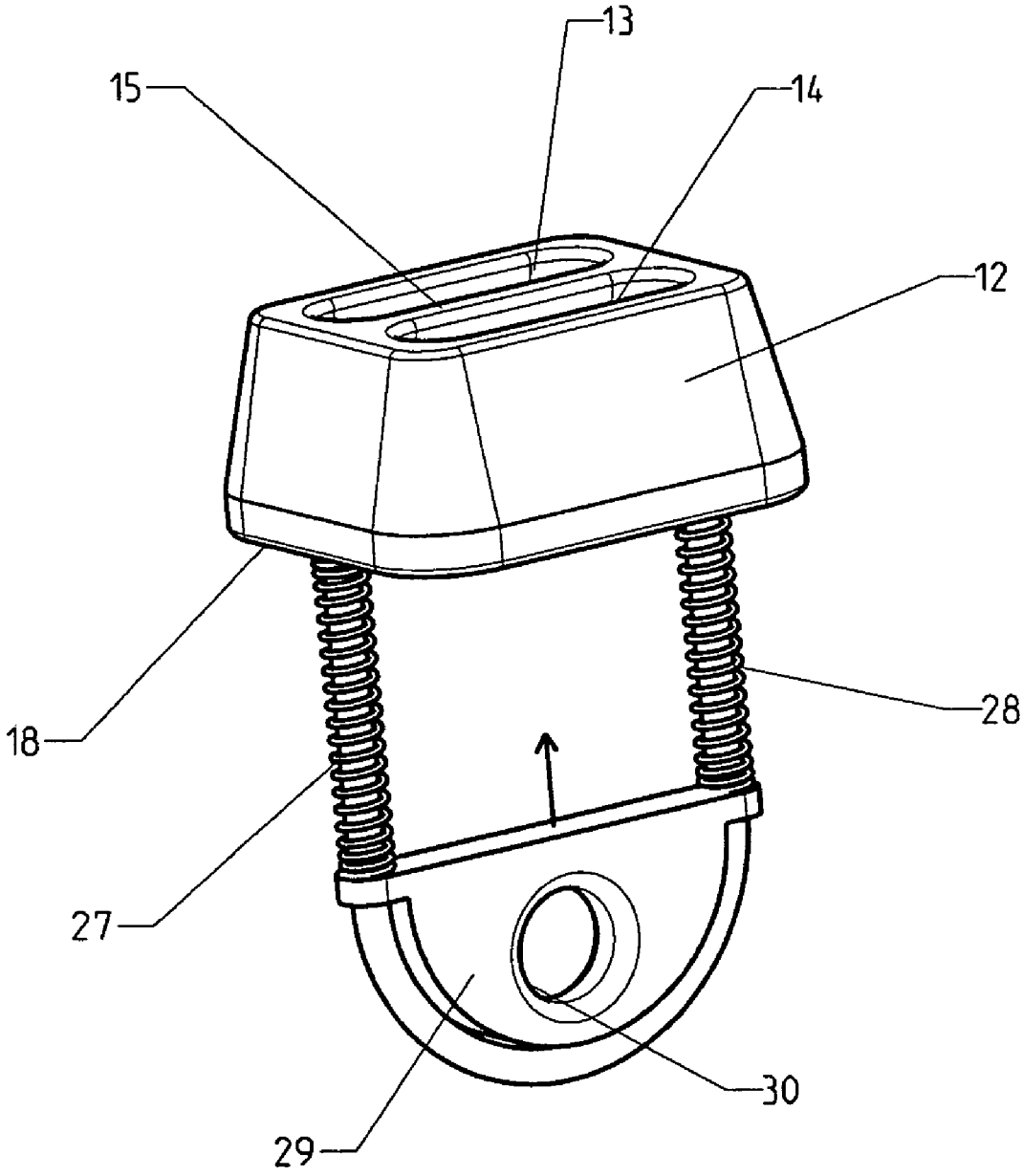

In FIG. 5, body 12 with slits 13, 14 is joined on the inside 18 thereof to two compression springs 27, 28 connected with a support 29. A circular hole 30 is drilled in the central part of the latter for carabiner 20 to pass. The two springs 27, 28 are preferably identical.

Figure 6:
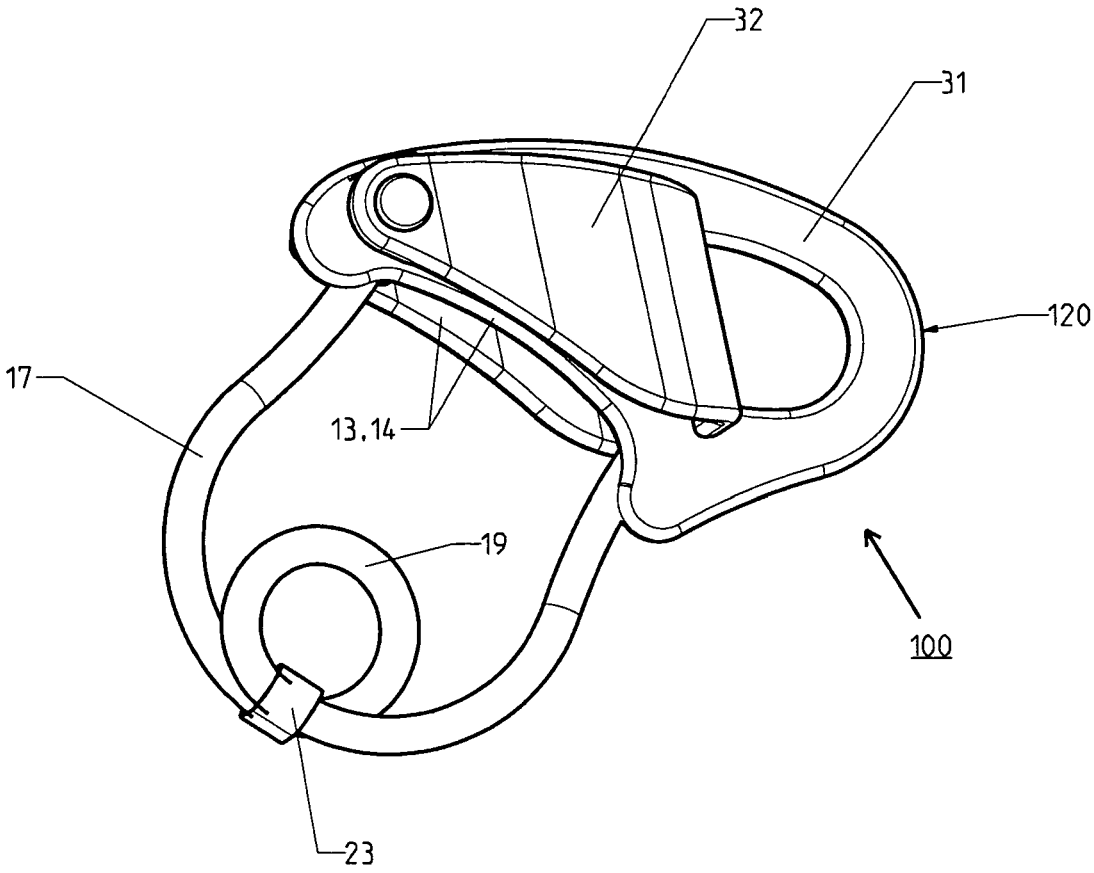

FIG. 6 concerns the belaying device 100 described in the document EP-A-1221327 and comprising a metal body 120 having a central flange-plate 31 on which a U-shaped clamp 31*a* is fitted so as to delineate the two slits 13, 14 on each side of flange-plate 31. Bow 17, instead of being rigid like metal flange-plate 31, is replaced by the flexible bow 17 according to the invention and illustrated for example in FIG. 1 of the present application.

Figure 7:
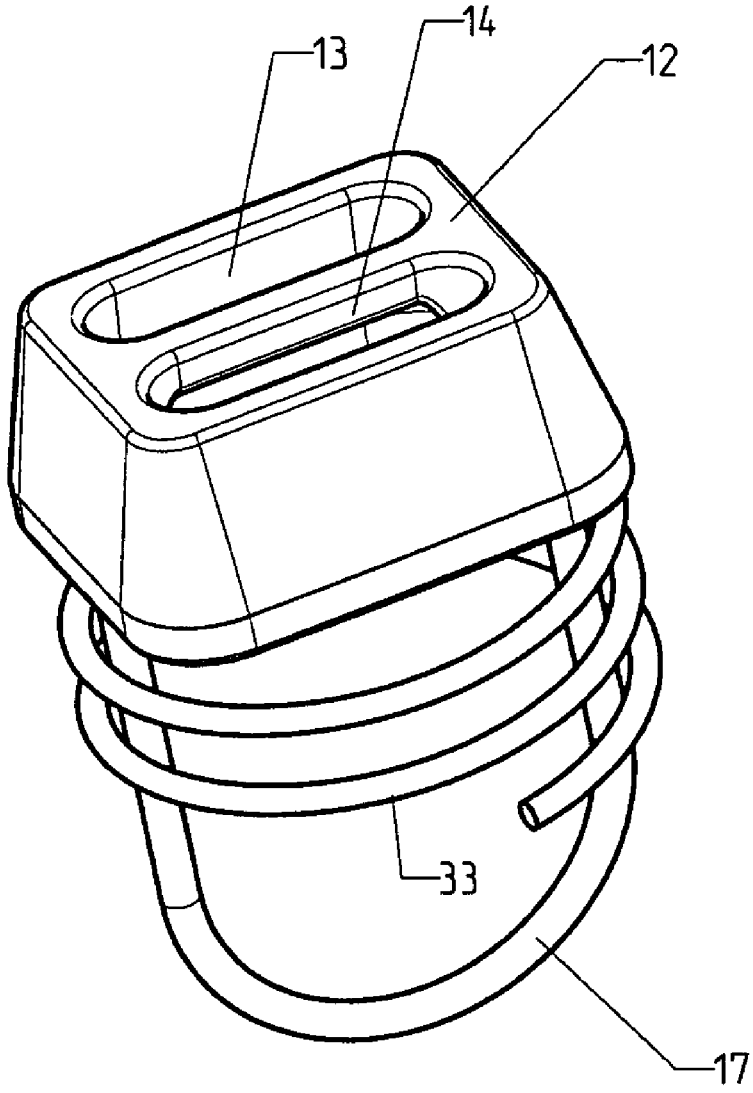

In FIG. 7, body 12 with slits 13, 14 is equipped with a helical spring 33 fixed to body 12 and extending in the direction of the fixed retaining element in the form of a bow 17. The height of bow 17 is larger than the axial length of helical spring 33.

Figure 8:
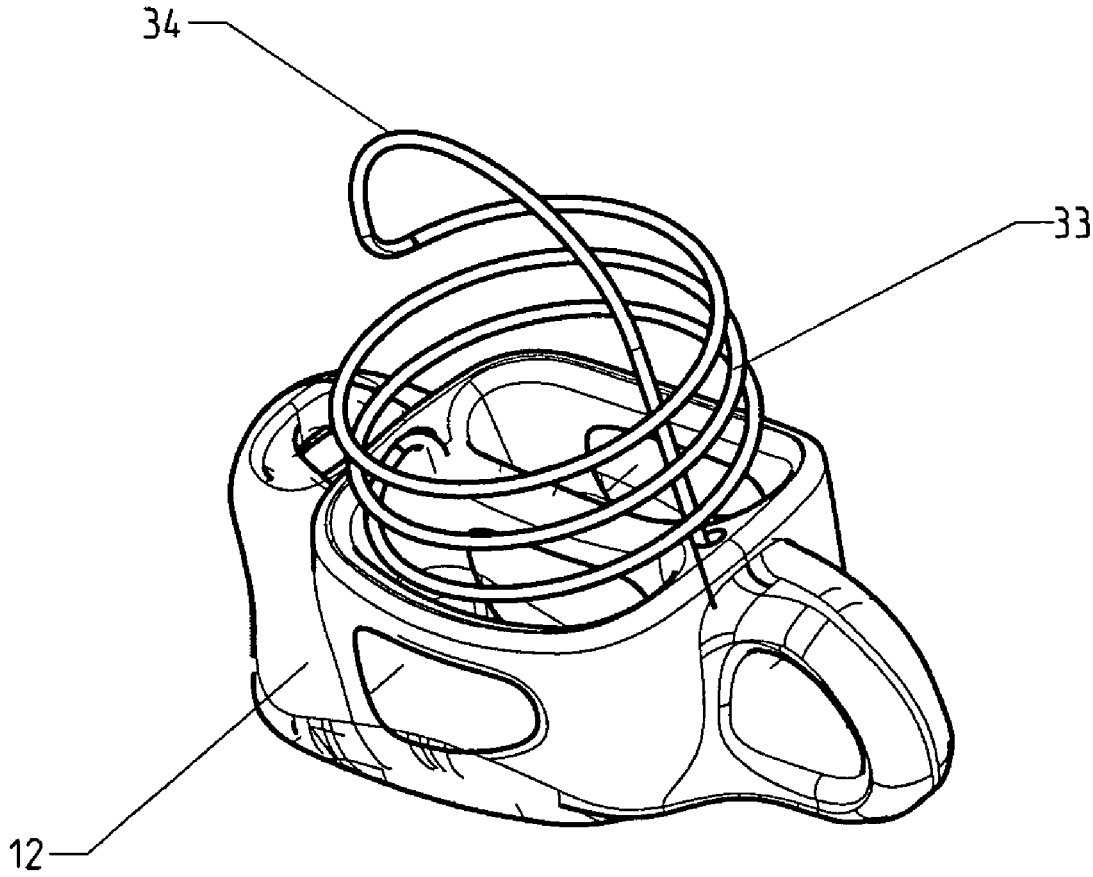

According to FIG. 8, helical spring 33 is extended by a closed turn 34 for the purposes of hooking the carabiner thereon, and acting as retaining element.

The invention claimed is:

1. A belaying device for a rope comprising:

a metal body having at least one slit configured to allow a loop of a rope to pass;

a flexible retaining element formed by an elastic bow, wherein both ends of the bow are securedly attached to the metal body; and a carabiner fixed to the elastic bow, wherein the elastic bow is configured to bring the carabiner closer to the metal body when tension is exerted on an upline strand of the rope, and to move the carabiner away from the metal body automatically when the rope is released.

2. The belaying device according to claim 1, wherein the body is shaped as a tubular plate with two slits, and is connected by two compression springs to a support in which a hole is drilled for passage of the carabiner.

3. The belaying device according to claim 1, wherein the metal body comprises a central flange-plate on which a U-shaped clamp is fixed to delineate the two slits.

4. The belaying device according to claim 1, wherein the elastic means are integral to the body, being separated from the retaining element.

5. The belaying device according to claim 4, wherein the elastic means are formed by a skirt made of deformable elastic material, said skirt being attached under the slits of the body.

6. The belaying device according to claim 4, wherein the elastic means are formed by a helical spring fixed to the body and extending in the direction of the retaining element.

7. The belaying device according to claim 6, wherein the retaining element in the form of a bow has a larger height than the axial length of the helical spring.

8. The belaying device according to claim 6, wherein the helical spring is extended by a closed turn for the purposes of hooking the carabiner thereon, and acting as retaining element.

9. The belaying device according to claim 1, wherein the retaining element is configured so as to render the carabiner captive.

10. The belaying device according to claim 9, wherein the retaining element is provided with an attachment structure or a securing part of the carabiner.

11. The belaying device according to claim 10, wherein the attachment structure is configured as a loop of the elastic bow extending from the bow toward the metal body, the loop of the elastic bow having an internal diameter corresponding to a cross-section of the carabiner.

12. The belaying device according to claim 11, wherein the loop of the elastic bow is secured by a strap crimped onto the bow.

13. The belaying device according to claim 10, wherein the securing part of the retaining element is arranged such as to render the carabiner captive.

* * * * *